US006753660B2

(12) United States Patent
Hartikka et al.

(10) Patent No.: US 6,753,660 B2
(45) Date of Patent: Jun. 22, 2004

(54) METHOD AND ARRANGEMENT WITH CONTROL GEAR, AND CONTROL GEAR

(75) Inventors: Yrjö Hartikka, Pennala (FI); Jari Kataja, Lahti (FI)

(73) Assignee: Teknoware Oy, Lahti (FI)

( * ) Notice: Subject to any disclaimer, the term of this patent is extended or adjusted under 35 U.S.C. 154(b) by 0 days.

(21) Appl. No.: 10/419,502

(22) Filed: Apr. 21, 2003

(65) Prior Publication Data

US 2003/0201736 A1 Oct. 30, 2003

(30) Foreign Application Priority Data

Apr. 30, 2002 (FI) ..... 20020821

(51) Int. Cl.[7] ..... H05B 37/02

(52) U.S. Cl. ..... 315/219; 315/224; 315/307; 315/312

(58) Field of Search ..... 315/224, 219, 315/307, 312

(56) References Cited

U.S. PATENT DOCUMENTS 5,877,592 A * 3/1999 Hesterman et al. ..... 315/16
6,362,575 B1 3/2002 Chang

FOREIGN PATENT DOCUMENTS

| | | |
|---|---|---|
| EP | 0 558 772 | 9/1993 |
| EP | 1 043 918 | 10/2000 |
| WO | WO 87/07996 | 1/1987 |

* cited by examiner

*Primary Examiner*—David Vu
(74) *Attorney, Agent, or Firm*—Leydig, Voit & Mayer, Ltd.

(57) ABSTRACT

A method and an arrangement in connection with a control gear arranged to control two parallel-connected fluorescent tubes, and a control gear, whereby the parallel-connected fluorescent tubes are fed using a single control gear in common, which comprises control arrangement arranged to provide output current for the control gear in response to a current reference. The method comprises controlling the control gear to provide output current having a first magnitude, determining continuously the working condition of the fluorescent tubes connected to the control gear, controlling the output current of the control gear to be divided substantially evenly between both fluorescent tubes, when the tubes are in working condition, detecting a change in the working condition of one or both of the tubes to be fed, changing the output current of the control gear to a second magnitude of the output current in response to the change detected in the working condition, and controlling the control gear to provide output current having the second magnitude.

20 Claims, 3 Drawing Sheets

METHOD AND ARRANGEMENT WITH CONTROL GEAR, AND CONTROL GEAR

BACKGROUND OF THE INVENTION

The invention relates to a method and an arrangement in connection with a control gear, and a control gear.

Fluorescent tubes are used to provide lighting in residential buildings, public premises and in public transportation vehicles. Fluorescent tubes provide adequate and natural lighting and in addition, the lighting is provided with low electrical power consumption.

What is generally used in connection with fluorescent tubes is electronic control gear providing high-frequency voltage for the tube. A control gear allows controlling the tube appropriately so that the controls required by the different operational stages of the tube can easily be taken into account. For example, when a fluorescent tube is turned on, a voltage should be provided between the electrodes thereof that is higher than the voltage in a conventional operating situation in order to provide higher electron emission.

A single electronic control gear may be employed to feed several fluorescent tubes. It is advantageous to use the fluorescent tubes in parallel, because in such a case each tube requires only the output side components of the control gear. The input side of the control gear typically comprises electronics for generating direct voltage from supplying voltage or otherwise forming the voltage to be suitable for the actual output part of the control gear. Components are thus saved when used in parallel and consequently space when installing the control gear.

Publication U.S. Pat. No. 6,362,575 illustrates a control gear that allows using several fluorescent tubes in parallel. The solution is based on observing the magnitude of the current in the electrodes at the other end of the tubes. The apparatus according to the publication detects a change in the number of tubes based on the observations on said current and increases the voltage to be fed to the tubes temporarily, while the number of tubes increases in order to ensure the ignition of the added tube. However, the presented solution provides such a drawback that when tubes are employed in parallel using the same voltage, the currents of the tubes deviate, which in turn results in luminous efficiencies of varying capacities between the tubes. Furthermore, the apparatus does not provide an indication of a damaged tube that needs to be changed.

BRIEF DESCRIPTION OF THE INVENTION

It is an object of the present invention to provide a method that avoids the above drawbacks and enables to reliably employ parallel-connected fluorescent tubes. This object is achieved with the method according to the invention, characterized by comprising the steps of controlling the control gear to provide output current having a first magnitude, determining continuously the working condition of the fluorescent tubes connected to the control gear, controlling the output current of the control gear to be divided substantially evenly between both fluorescent tubes, when said tubes are in working condition, detecting a change in the working condition of one or both of the tubes to be fed, changing the output current of the control gear to a second magnitude of the output current in response to the change detected in the working condition, and controlling the control gear to provide output current having the second magnitude.

The method according to the invention is based on the idea that the working condition of fluorescent tubes is continuously under observation, and when a change is detected in the working condition of the fluorescent tubes, the control gear is used to change the magnitude of the current. In addition, in the method according to the invention, both fluorescent tubes are provided with current of the same magnitude, when the tubes are in working condition. The method according to the invention provides a distinct indication concerning the working condition of the tubes. Furthermore, since the same current is fed into both tubes, the lighting provided by the tubes does not significantly deviate from one another.

The invention also relates to an arrangement in connection with a control gear arranged to control two parallel-connected fluorescent tubes. The control gear comprises control means arranged to provide output current for the control gear in response to a current reference, whereby the control means are arranged to control the control gear to provide output current having a first magnitude. The arrangement is characterized by further comprising means for determining the working condition of the fluorescent tubes connected to the control gear, means for changing the output current of the control gear to a second magnitude of the output current in response to the change in the working condition of the fluorescent tubes, and means for dividing the output current of the control gear between the fluorescent tubes connected to the control gear, when both tubes are in working condition, and also means for controlling the division means of the output current.

Such an arrangement allows achieving the advantages, the method according to the invention offers using a simple and therefore advantageous apparatus.

The invention further relates to a control gear for controlling two parallel-connected fluorescent tubes. The control gear comprises a control part and an inverter part, whereby the control part is arranged to control the inverter part in order to provide output current of the control gear, and elements for determining the working condition of the cathodes in the fluorescent tubes connected to the control gear. The control gear is characterized by further comprising a current balancing inductor arranged to provide both fluorescent tubes with tube current of substantially the same magnitude, when both tubes are in working condition, a current measuring resistor arranged to determine the magnitude of the output current in the control gear and is connected to a control part in order to indicate the magnitude of the output current to the control part, and also a change-over switch arranged to simultaneously change the magnitude of the current measuring resistor and to switch the current balancing inductor into use or out of use in response to the elements for determining the working condition of the cathodes in the fluorescent tubes connected to the control gear.

Such a control gear enables to reliably implement the advantages the method according to the invention provides and to use a simple structure.

BRIEF DESCRIPTION OF THE DRAWINGS

In the following the invention will be described in greater detail by means of the preferred embodiments with reference to the accompanying drawings, in which.

DETAILED DESCRIPTION OF THE INVENTION

Figure 1:
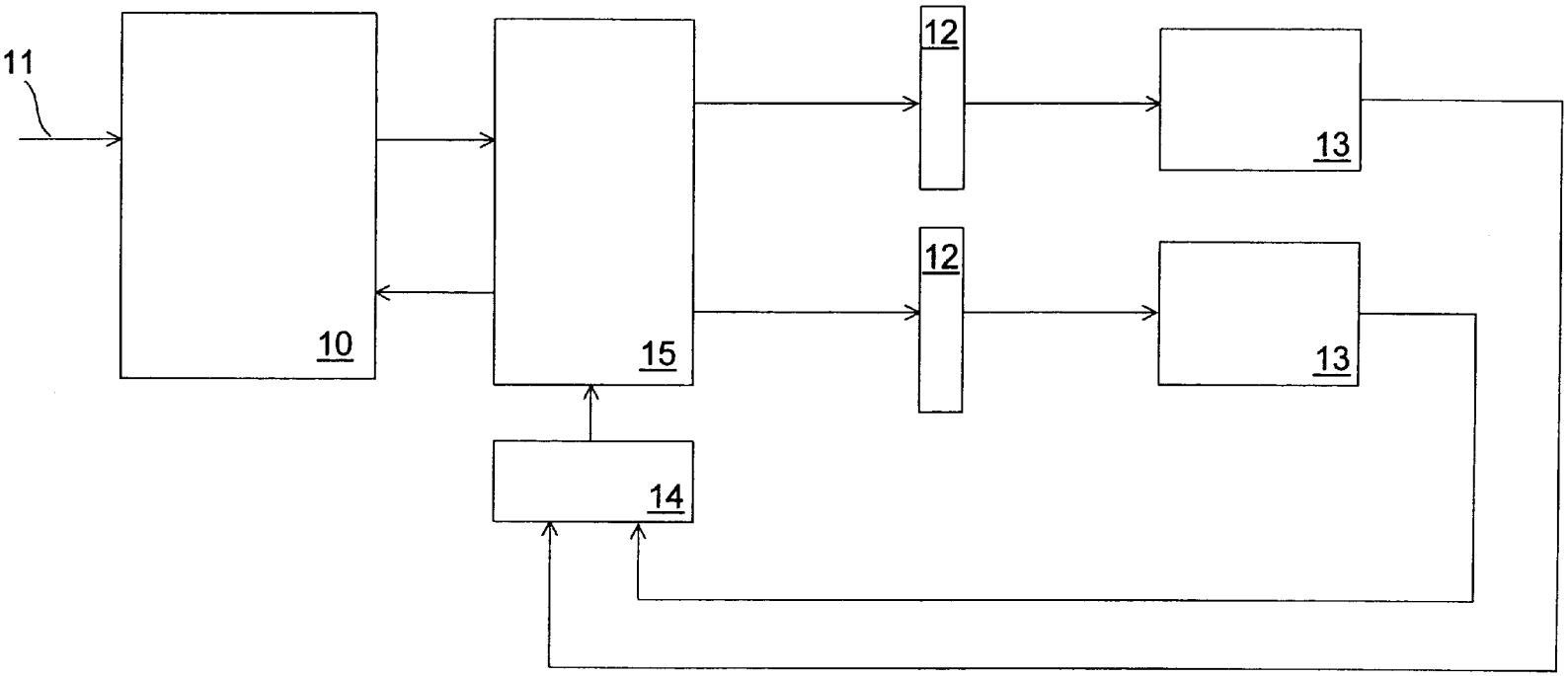
FIG. 1 is a block diagram showing a control gear and an arrangement according to the invention.

FIG. 1 is a block diagram schematically showing a control gear and an arrangement according to the invention. The block diagram illustrates control means and a power unit 10, in which the power unit is provided with a voltage feed to an input 11 and uses this voltage controlled by the control means for feeding fluorescent tubes 12. In accordance with the invention, the control means are current controlled, meaning that the control means tend to implement the current reference provided thereto. According to the invention, the control means are arranged to control the control gear and the power unit thereof to provide output current having a first magnitude.

In accordance with the invention, the control gear is controlled to provide output current having a first magnitude. This is implemented using the control means arranged to control the control gear and particularly the power unit thereof to provide said output current. The control means of the control gear may for instance be implemented by means of an integrated circuit provided with several control features. Such a circuit controls the components in the power unit to implement a voltage or current reference to the output of the control gear. The solution of the invention is based in particular on a current controlled control gear. Typically, the power unit of the control gear is an inverter that provides the desired output current from the direct voltage in the input thereof.

The invention relates to controlling two parallel-connected fluorescent tubes, whereby one control gear is used to control two fluorescent tubes 12. The method according to the invention comprises a step, in which the working condition of the fluorescent tubes connected to the control gear is constantly being determined. For this purpose, the arrangement according to the invention comprises means 13 for determining the working condition of the fluorescent tubes connected to the control gear. If both fluorescent tubes are in operation, the output current of the control gear is controlled in accordance with the method according to the invention to be divided substantially evenly between the fluorescent tubes using means 15, and also for controlling the division means of the output current using means 14.

The means 13 provide an indication if the cathode or the cathode circuit in the fluorescent tube is damaged, in which case the tube is out of order. Based on such an indication, the control gear changes the output current thereof to a second magnitude, which is only intended for burning a single fluorescent tube. In accordance with the arrangement according to the invention, the arrangement comprises means 15 for changing the output current of the control gear to the second magnitude of the output current in response to the change in the working condition of the fluorescent tubes. When an indication concerning the defectiveness of the fluorescent tube is obtained, the control gear is controlled to provide current having the second magnitude.

Figure 2:
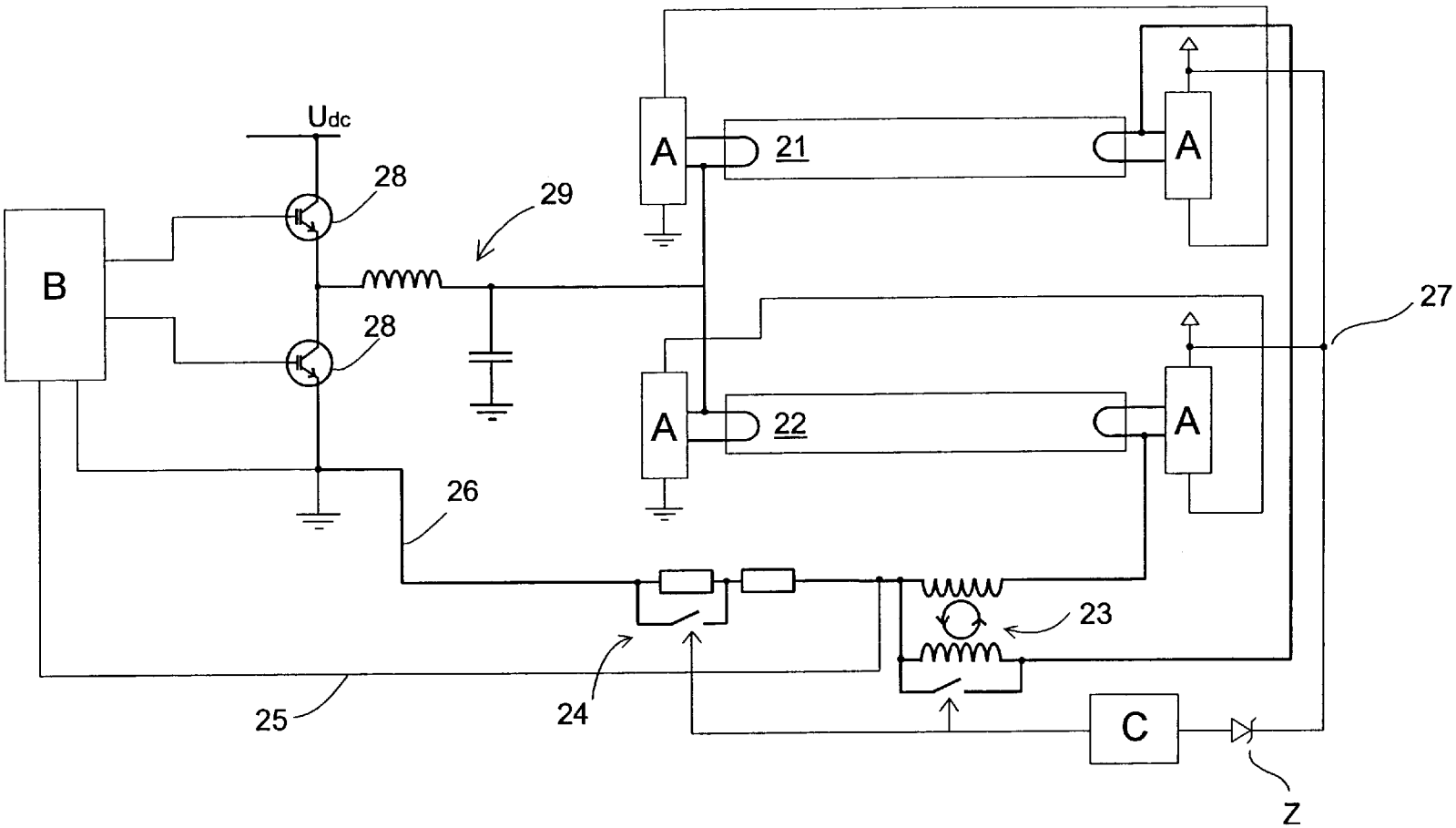
FIG. 2 schematically shows a main circuit of the control gear according to the invention.

FIG. 2 schematically shows the main circuit of the control gear and the arrangement according to the invention. In the method of the invention, output current is fed using the power unit of the control gear into fluorescent tubes 21, 22, and the condition of the fluorescent tubes is constantly observed using observation elements A. Said elements are used to provide an indication concerning the working condition of the fluorescent tubes. FIG. 2 shows a control part B of the control gear as well as power switches 28. The control part controls as is known in the art the power switches to provide the desired output current from the direct voltage $U_{dc}$.

When both fluorescent tubes 21, 22 are in condition, a current balancing inductor 23 arranged in the control gear or in connection therewith forces the magnitudes of both tube currents in the tubes to be substantially equal. Such an inductor 23 allows the tubes to be evenly loaded, thus providing a smooth lighting. The power of the fluorescent tubes 21, 22 may vary without affecting the solution according to the invention in any way. A deviation in tube power may nevertheless affect the amount of lighting provided by the tubes, as the currents of both tubes are equal.

When malfunction is detected in a fluorescent tube by means of element A in the method of the invention, control element C is provided with information about it, element C being arranged to control the switches in connection with the current balancing inductor 23 and a resistance circuit 24. Such switches are used to change the resistance of the resistance circuit 24 and the connection of the current balancing inductor 23. The resistance circuit 24 is used to inform about the magnitude of the current flowing in the lamp circuit so that the current flows through the resistance circuit, in which case a voltage proportional to the magnitude of the current remains over it. The control part of the control gear is provided with voltage information concerning the magnitude of the current from the voltage difference between a signal path 25 and a return path 26 of the lamp current.

The current balancing inductor 23 is schematically implemented as a transformer, which has a transformation ratio of one, and in which the windings are formed so that the current directions in the tubes are always opposed to one another and of the same magnitude. What may flow through the inductor in such a case is only a common mode current. In FIG. 2, the actual tube current circuit is darkened and comprises output power switches 28, a connection 29 of the inductor and capacitor connected to the output and the fluorescent tubes 21, 22. The current circuit also includes the current balancing inductor 23 and the resistance circuit 24.

As mentioned above, when the working condition of a fluorescent tube changes, the magnitude of the output current in the control gear is changed. When a change occurs from feeding two parallel-connected fluorescent tubes to feeding a single tube, the output current should be reduced in accordance with the invention and at the same time, the current balancing inductor 23 should not be used. The output current is reduced by changing the magnitude of the resistance circuit 24 to be used in connection with current measuring. Thus, control element C is employed to control two switches in such a manner that the switch connected over a second winding of the current balancing inductor is short circuited and the resistance of the resistance circuit is increased by opening the switch in the resistance circuit, thereby increasing the value of the current measuring resistor.

The resistance circuit shown in FIG. 2 is simply formed of two resistors connected in series, one of which being short-circuited using a controllable switch. When the value of a current determination resistance changes, the voltage information obtained from signal paths 24 and 25 to be provided for the control part of control gear B also changes. Since the reference value of the output current provided for the control gear is not changed, the control part changes the. output current of the control gear in such a manner that the change in the current measuring resistor is compensated for and the voltage between the signal paths 24, 25 reverts to correspond with the reference value. While increasing the current measuring resistor, the output current of the control gear is reduced conversely in relation to the increase of the resistance.

Figure 3:
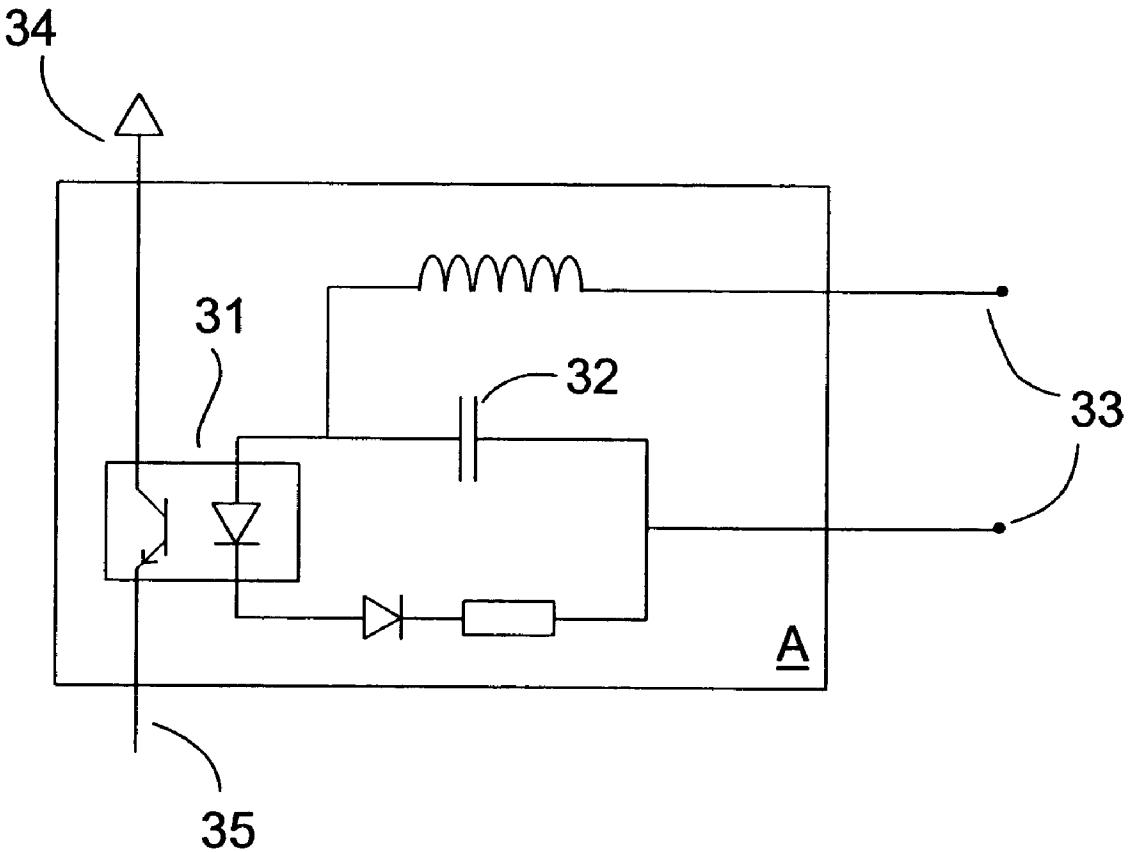
FIG. 3 shows how the observation elements in the cathode circuits of the fluorescent tubes are connected.

Observation elements A that in accordance with the invention constantly observe the working condition of the cathodes in the fluorescent tubes are, for instance, formed from the circuit shown in FIG. 3. The circuit comprises an opto-coupler 31, whose photodiode controls the switch into an open or closed position depending on whether current flows through the photodiode. The circuit also includes a limiting capacitor 32 of cathode current, and the value of the voltage thereof may indicate the working condition of the cathode circuit or cathode connected to terminals 33. If the capacitor 32 is charged, the cathode circuit is in condition, and current flows through the photodiode in the opto-coupler. When the cathode circuit is in turn damaged, the capacitor is not provided with voltage that would make the photodiode conductive.

A terminal 34 of the opto-coupler transistor is connected to the voltage in FIG. 3. While the transistor conducts, the voltage moves to a transistor terminal 35. FIG. 2 shows the circuit of observation elements A. In this circuit, the observation elements of both cathodes in a single fluorescent tube are connected in series. The circuit can also be implemented in such a manner that each observation element A operates independently. An observation element controls control element C in such a manner that when the cathode circuits are in condition, points 27 of elements A are connected through said elements to the earth potential. When the cathode circuit is cut off, the current cannot flow through elements A to the earth, in which case the potential of point 27 increases and control element C is provided with voltage through zener diode Z and performs the switching measures that allow changing the resistance of the resistance circuit 24 and the current balancing circuit 23.

The arrangement and control gear of the invention are typically also provided with a function that allows identifying when a tube is changed in the control gear. When connecting the tube to a lamp circuit is detected, the control part of the control gear is provided with a signal. The control gear changes its output in response to this signal in such a manner that it temporarily increases the output voltage in order to ensure the ignition of the added tube.

The control means 10 shown in FIG. 1 is, for instance, a commercially available gate driver, which fulfils the requirements concerning the inputs and outputs, set by the invention. The control means 10 may also be implemented using discrete components. The gate driver enables to simply integrate several functions to the control gear, such as dimming and temperature control. If the dimming function is employed, it is apparent that the first and second predetermined output currents according to the invention are not of standard magnitude, but change during dimming. However, the solution according to the invention considers the dimming function, since changing the value of the current depending on the working condition of the fluorescent tubes according to the invention to the value of the output current can be affected through the feedback of a control circuit.

It is obvious for those skilled in the art that the basic idea of the invention can be implemented in various ways. The invention and the embodiments thereof are therefore not limited to the above examples but may vary within the scope of the claims.

What is claimed is:

1. A method in connection with a control gear arranged to control two parallelly-connected fluorescent tubes, whereby said single common control gear is employed to feed the parallel-connected fluorescent tubes, the control gear comprising control means arranged to provide an output current for the control gear in response to a current reference, the method comprising the steps of controlling the control gear to provide said output current having a first magnitude, determining continuously the working condition of the fluorescent tubes connected to the control gear, controlling the output current of the control gear to be divided substantially evenly between both fluorescent tubes, when said tubes are in working condition, detecting a change in the working condition of one or both of the tubes to be fed, changing the output current of the control gear to a second magnitude of the output current in response to the change detected in the working condition, and controlling the control gear to provide said output current having the second magnitude.

2. The method as claimed in claim 1, wherein the step of controlling the control gear comprises the steps of pre-selecting the first and second magnitude of the output current, determining the magnitude of the output current in the control gear, controlling the output current in the control gear to one of the magnitudes.

3. The method as claimed in claim 2, further comprising the step of determining the magnitude of the output current in the control gear, which step comprises the steps of measuring voltage loss in a current measuring resistor, and feeding the measured voltage loss into the control means of the control gear.

4. The method as claimed in claim 3, wherein the step of changing the output current in the control gear comprises changing the magnitude of the value of the voltage measuring resistor determining the output current in response to the detected change in the working condition of at least one of the tubes, whereby the control means in the control gear changes the reference value of the output current.

5. The method as claimed in claim 3, wherein the step of changing the output current of the control gear comprises short-circuiting the current balancing inductor of the tube currents in response to the detected damaged fluorescent tube.

6. The method as claimed in claim 2, wherein the first magnitude of the output current in the control gear is a current value used to feed the two parallel-connected fluorescent tubes, and the second magnitude is a current value used to feed a single said fluorescent tube.

7. The method as claimed in claim 2, wherein the step of changing the output current in the control gear comprises changing the magnitude of the value of the voltage measuring resistor determining the output current in response to the detected change in the working condition of at least one of the tubes, whereby the control means in the control gear changes the reference value of the output current.

8. The method as claimed in claim 2, wherein the step of changing the output current of the control gear comprises short-circuiting the current balancing inductor of the tube currents in response to the detected damaged fluorescent tube.

9. The method as claimed in claim 1, wherein the first magnitude of the output current in the control gear is a current value used to feed the two parallel-connected fluorescent tubes, and the second magnitude is a current value used to feed a single said fluorescent tube.

10. The method as claimed in claim 9, wherein further comprising the step of determining the magnitude of the output current in the control gear, which step comprises the steps of measuring voltage loss in a current measuring resistor, and feeding the measured voltage loss into the control means of the control gear.

11. The method as claimed in claim 1, wherein the step of changing the output current in the control gear comprises, changing the magnitude of the value of a voltage measuring resistor determining the output current in response to the detected change in the working condition of at least one the tubes, whereby the control means in the control gear changes the reference value of the output current.

12. The method as claimed in claim 11, wherein the step of changing the output current of the control gear comprises short-circuiting the current balancing inductor of the tube currents in response to the detected damaged fluorescent tube.

13. The method as claimed in claim 1, wherein the step of changing the output current of the control gear comprises short-circuiting a current balancing inductor of the tube currents in response to the detected damaged fluorescent tube.

14. The method as claimed claim 1, wherein the step of changing the output current of the control gear comprises adding a current of a current balancing inductor of the tube to the current path of the tube currents in response to the detected increase of tubes in working condition, the current balancing inductor being arranged to force the tube currents of both tubes to be substantially equal.

15. An arrangement in connection with a control gear arranged to control two parallel-connected fluorescent tubes, the control gear comprising control means arranged to provide an output current for the control gear in response to a current reference, whereby the control means are arranged to control the control gear to provide the output current having a first magnitude, wherein the arrangement further composes means for determining the working condition of the fluorescent tubes connected to the control gear, means for changing the output current of the control gear to a second magnitude of the output current in response to a change in the working condition of the fluorescent tubes, and means for dividing the output current of the control gear between the fluorescent tubes connected to the control gear, when both tubes are in working condition, and means for controlling the dividing means of the output current.

16. The arrangement as claimed in claim 15, wherein the means for determining the working condition comprise elements that are electrically connected to cathodes of the fluorescent tubes, the elements being arranged to observe a voltage affecting over the cathodes and to provide an indication concerning a malfunction or lack of the fluorescent tubes, when the voltage goes below a predetermined limit.

17. The arrangement as claimed in claim 16, wherein the means for changing the output current of the control gear comprise means for determining the magnitude of the output current, the means for determining the magnitude of the output current comprising a changeable property, and the means for changing the output current of the control gear further comprising means for changing the changeable property in response to the means for determining the working condition.

18. The arrangement as claimed in claim 15, wherein the means for changing the output current of the control gear comprise means for determining the magnitude of the output current, the means for determining the magnitude of the output current comprising a changeable property, and the means for changing the output current of the control gear further comprising means for changing the changeable property in response to the means for determining the working condition.

19. The arrangement as claimed in claim 18, wherein the means for changing the changeable property and the means for controlling the dividing means of the output current comprise a change-over switch circuit.

20. A control gear for controlling two parallelly-connected fluorescent tubes comprising a control part and an inverter part, whereby the control part is arranged to control the inverter part for providing output current for the control gear, said fluorescent tubes comprising cathodes, and elements for determining the working condition of the cathodes in the fluorescent tubes being connected to the control gear, wherein the control gear further comprises a current balancing inductor arranged to provide both fluorescent tubes with tube current of substantially the same magnitude, when both tubes are in working condition, a current measuring resistor arranged to determine the magnitude of the output current in the control gear, and connected to a control part in order to indicate the magnitude of the output current to the control part, and a change-over switch arranged to simultaneously change the magnitude of the current measuring resistor and to switch the current balancing inductor into use or out of use in response to the elements for determining the working condition of the cathodes in the fluorescent tubes connected to the control gear.

* * * * *